US007150504B1

(12) United States Patent
Lee

(10) Patent No.: US 7,150,504 B1
(45) Date of Patent: Dec. 19, 2006

(54) ADJUSTMENT MECHANISM FOR HANDRAIL

(76) Inventor: Hwang-Pao Lee, No. 807, Po-Ai Street, Chu-Pei City, 302,Hsin-Chu(County) (TW)

( * ) Notice: Subject to any disclaimer, the term of this patent is extended or adjusted under 35 U.S.C. 154(b) by 0 days.

(21) Appl. No.: 11/267,500

(22) Filed: Nov. 7, 2005

(51) Int. Cl.
*A47C 7/54* (2006.01)

(52) U.S. Cl. ..... 297/411.35

(58) Field of Classification Search ..... 297/411.35, 297/411.37, 411.38
See application file for complete search history.

(56) References Cited

U.S. PATENT DOCUMENTS

| | | | | |
|---|---|---|---|---|
| 5,484,187 | A * | 1/1996 | Doerner et al. | 297/411.3 |
| 5,641,203 | A * | 6/1997 | Van De Riet et al. | 297/411.37 |
| 5,927,811 | A * | 7/1999 | Tseng | 297/353 |
| 6,017,091 | A * | 1/2000 | Cao | 297/411.37 |
| 6,059,366 | A * | 5/2000 | Hu | 297/411.35 |
| 6,540,300 | B1 * | 4/2003 | Piretti | 297/411.35 |
| 6,948,775 | B1 * | 9/2005 | Tsai | 297/411.37 |
| 2002/0070598 | A1 * | 6/2002 | Perl | 297/411.35 |
| 2003/0030317 | A1 * | 2/2003 | Chen | 297/411.35 |

* cited by examiner

*Primary Examiner*—Peter R. Brown
(74) *Attorney, Agent, or Firm*—Troxell Law Office, PLLC

(57) ABSTRACT

An adjustment mechanism for handrails is disclosed. A lower plate is secured below a handrail body so that an inner space for accommodating the adjustment mechanism is formed between the handrail body and the lower plate. Two linear locating slots are symmetrically disposed on inner left and right sides of the lower plate and a removable block is arranged between the two linear locating slots. An elastic locating ring is disposed on right and left sides of the removable block and the locating ring locks into a curved slot of the linear locating slots for being located. Thus the lower plate slides forwards and backwards relative to the removable block, and also being located by the locating ring. Furthermore, a round slot is arranged on the removable block for being assembled with a disc. The center of the disc, the removable block, a sliding slot of the lower plate, and a base are fastened together. The base is secured on the handrail support. Two sets of locating slots are arranged on edge of the circumference of the disc while an elastic locating pin is disposed on front edge and rear edge of the round slot so that the locating pin elastically locks into the locating slot of the disc for being located. And the removable block rotates at an angle, relative to the disc and being located by the locating pin. Therefore, the rotation angle and longitudinal positions of the handrails can be adjusted.

6 Claims, 6 Drawing Sheets

ADJUSTMENT MECHANISM FOR HANDRAIL

BACKGROUND OF THE INVENTION

The present invention relates to an adjustment mechanism for handrails, especially to a handrail with adjustable height, width and angles.

Generally, common seat handrails consist of two parts-handrails and supports. The handrails are disposed on top of the supports while the supports are secured firmly on right and left sides of seats by screws or other means. The traditional adjustment mechanism for handrails is for adjusting longitudinal position, angles or height. The height-adjustment mechanism generally is arranged on the supports while the longitudinal or angle adjustment mechanism is installed on the handrails. Although there are various adjustment mechanisms available now, an adjustment mechanism with simple structure and multiple functions of adjusting longitudinal position or angle is rare.

The present invention provides such kind of design.

SUMMARY OF THE INVENTION

It is therefore a primary object of the present invention to provide an adjustment mechanism for handrails. A lower plate is secured below a handrail body so that an inner space is formed between the handrail body and the lower plate. Two linear locating slots are symmetrically disposed on inner left and right sides of the lower plate and a removable block is arranged between the two linear locating slots. An elastic locating ring is disposed on right and left sides of the removable block and the locating ring locks into a curved slot of the linear locating slots for being located. Thus the lower plate slides forwards and backwards relative to the removable block, and also being located by the locating ring. Moreover, a round slot is arranged on the removable block for being assembled with a disc. The center of the disc, the removable block, a sliding slot of the lower plate, and a base are fastened together.

Two sets of locating slots are disposed on edge of the circumference of the disc while an elastic locating pin is disposed on front edge and rear edge of the round slot so that the locating pin elastically lock into the locating slot of the disc for being located. And the removable block rotates at an angle, relative to the disc and being located by the locating pin. Therefore, the rotation angle and longitudinal positions of the handrails can be adjusted.

It is a further object of the present invention to provide an adjustment mechanism for handrails. The present invention includes the disc on the removable block fastened and integrated with a sliding slot of the lower plate and a base. By lock holes on two sides thereof, the base is secured on the support of handrails. Thus the adjustment mechanism for the assembly of the handrail body and the lower plate is mass-produced and then is assembled with the base according to users' needs. After assembling, the assembly and the handrail support can be packaged or transported separately and this is convenient for production and sales.

DETAILED DESCRIPTION OF THE PREFFERED EMBODIMENT

Figure 1:
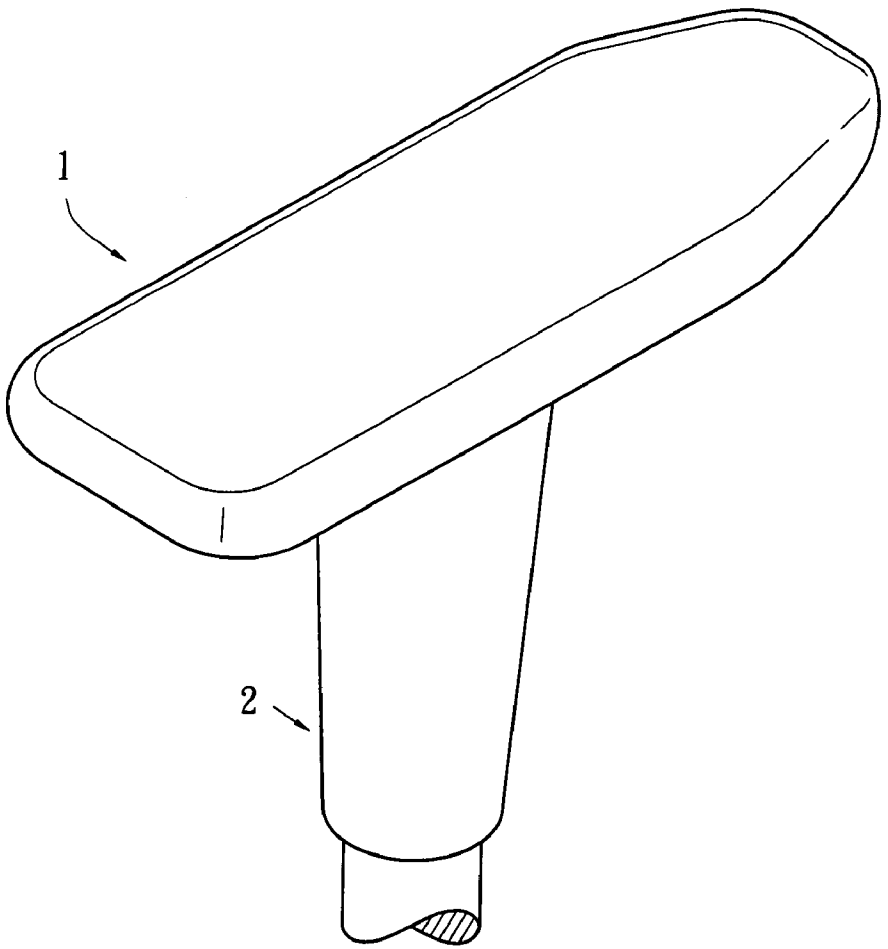
FIG. 1 is a perspective view of an embodiment in usage according to the present invention.
Figure 2:
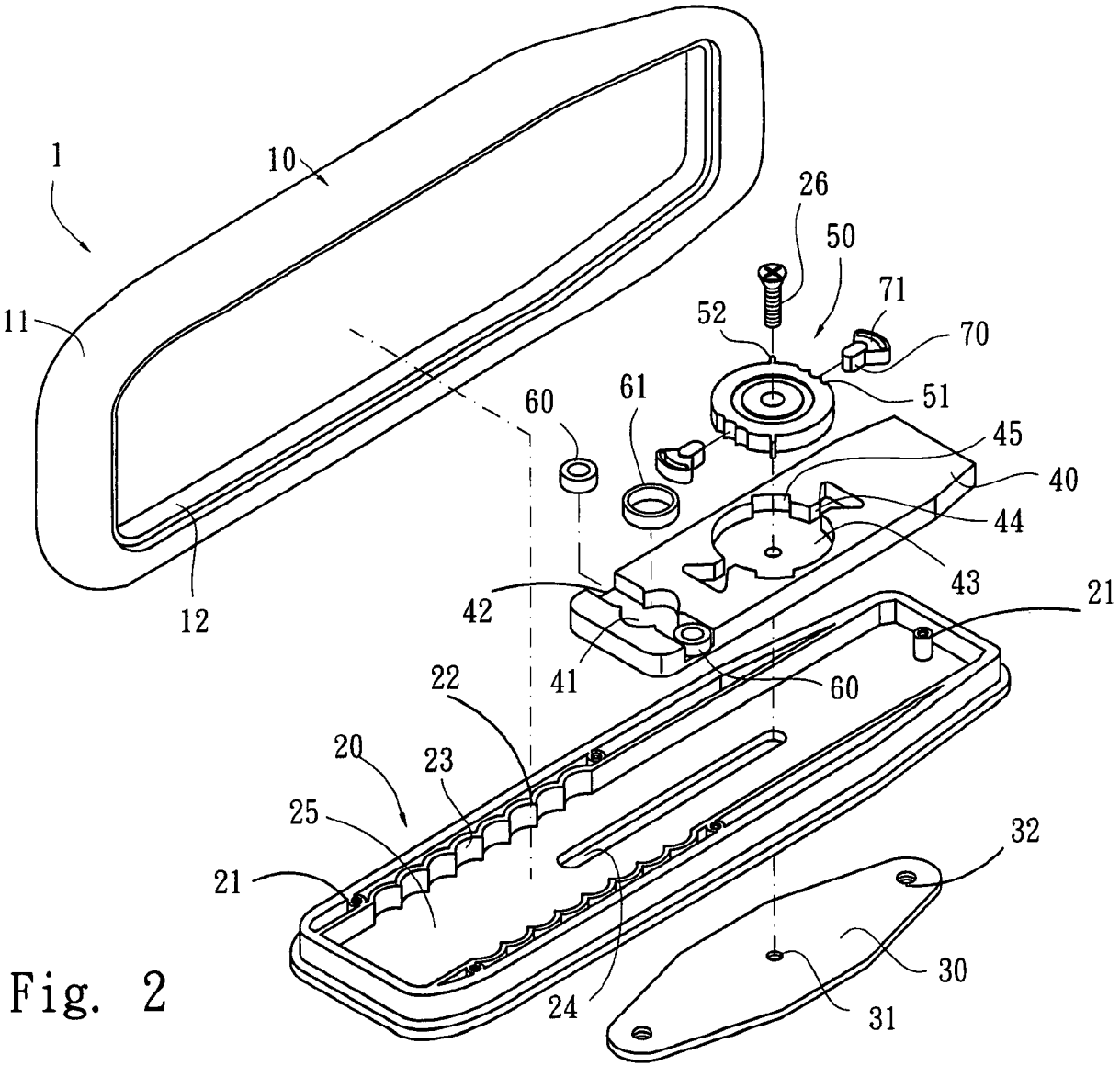
FIG. 2 is an explosive view of an embodiment in accordance with the present invention.
Figure 3:
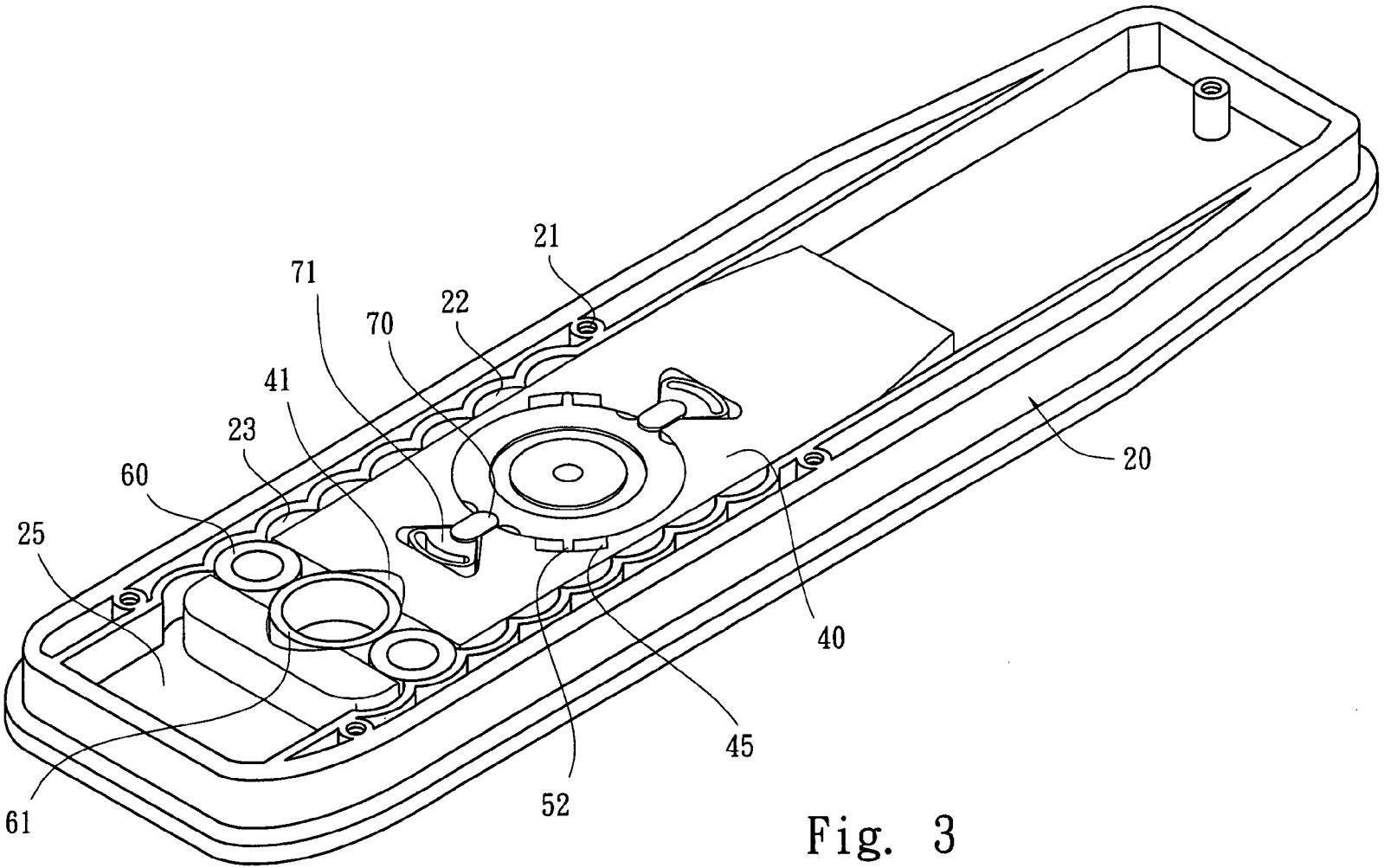
FIG. 3 is a schematic drawing of partial assembly of an embodiment in accordance with the present invention.

Refer from FIG. 1 to FIG. 3, a handrail 1 of the present invention is fixed on top of a handrail support 2. The handrail 1 consists of a handrail body 10, a lower plate 20, a base 30, a removable block 40, a disc 50, a locating ring 60 as well as corresponding elastic member 61, a locating pin 70 and corresponding elastic member 71. The handrail body 10 is formed by an upper soft pad layer 11 integrated with a lower hard plate layer 12. While being manufactured, the hard plate layer 12 is set into a mold for integration. The soft pad layer 11 made from plastic, rubber, or sponge provides users good feeling of touch while the hard plate layer 12 is made from iron or plastic and having a plurality of tapped holes for being assembled with the lower plate 20. The lower plate 20 is a plastic concave housing, screwed on the hard plate layer 12 of the handrail body 10 so as to form a rectangular space 25 between the handrail body 10 and the lower plate 20 for accommodation of adjustment parts such as the removable block 40, the disc 50, the locating ring 60, the elastic member 61, the locating pin 70 and the elastic member 71.

A plurality of tapped holes 21 arranged on the lower plate 20 correspond to the tapped holes on the handrail body 10 for being secured with each other. Two linear locating slots 22 including a plurality of identical curved slots 23 are symmetrically disposed on inner left and right sides of the lower plate 20. A removable block 40 arranged between the two linear locating slots 22 is able to move forwards and backwards inside the rectangular space 25 of the lower plate 20. A transverse 41 groove with two slots 42 on right and left sides thereof is mounted on the removable block 40. The slot 42 is used for accommodating the locating ring 60. The elastic member 61 is set between the two locating rings 60. The elastic member 61 made from elastic rubber can push the locating ring 60 into the curved slot 23 of the linear locating slots 22 by its elasticity while the locating rings 60 also have elasticity so as to avoid noise caused by friction between the lower plate 20 and the removable block 40. The locating rings 60 can prevent stress between the lower plate 20 and the removable block 40 that may lead to difficulties in adjustment. Moreover, a gap is disposed on inner right and left sides of the lower plate 20 and the linear locating slots 22 so as to increase the elasticity of the locating rings 60 against the linear locating slots 22. Thus the locating rings 60 won't press the linear locating slots 22 tightly and it is easy to move for adjustment.

A round slot 43 is arranged on center of the removable block 40 for assembled with the disc 50. Two sets of locating slots 51 are disposed on edge of the circumference of the disc 50. As show in figure, each set has three locating slots 51, located on the central line, center-left and center-right side of the disc 50 respectively so as to make the handrail body 10 move in three directions—linearly, center-left side and center-right side.

A race 44 is disposed on front edge and rear edge of the round slot 43. A locating pin 70 corresponding to the two sets of locating slots 51 of the disc 50 is mounted inside the race 44. The locating pin 70 is assembled with the elastic member 71 that is a hollow rubber part with elasticity. The elastic member 71 acts on the locating pin 70 just like the elastic member 61 for the locating rings 60. By the elasticity itself, the elastic member 71 presses the locating pin 70 moving into the locating slot 51 of the disc 50. The two locating pins 70 has elasticity against contiguous parts so as to avoid noise caused by crash between the removable block 40 and the disc 50. The difficulties in adjusting the angle due to stress between the removable block 40 and the disc 50 can also be reduced. Moreover, two central-angle slots 45 corresponding to a tenon 52 on the disc 50 respectively are arranged on circumstance of the round slot 43. The tenon 52 moves inside the central-angle slot 45 so as to restrict the rotation angle of the removable block 40 toward the disc 50. It is further avoided that once the locating pin 70 leaves the locating slot 51 due to force of users, the handrail 1 can't be located after rotating a certain angle.

Furthermore, by a fastening member 26 (such as screws) inserting through the center of the disc 50, the removable block 40, longitudinal sliding slot 24 of the lower plate 20 and a central hole 31 of the base 30, the disc 50 is fastened with the base 30. A hole 32 is disposed on two sides of the base 30 respectively for fastening the base 30 into the handrail support 2, as shown in FIG. 1.

Figure 4:
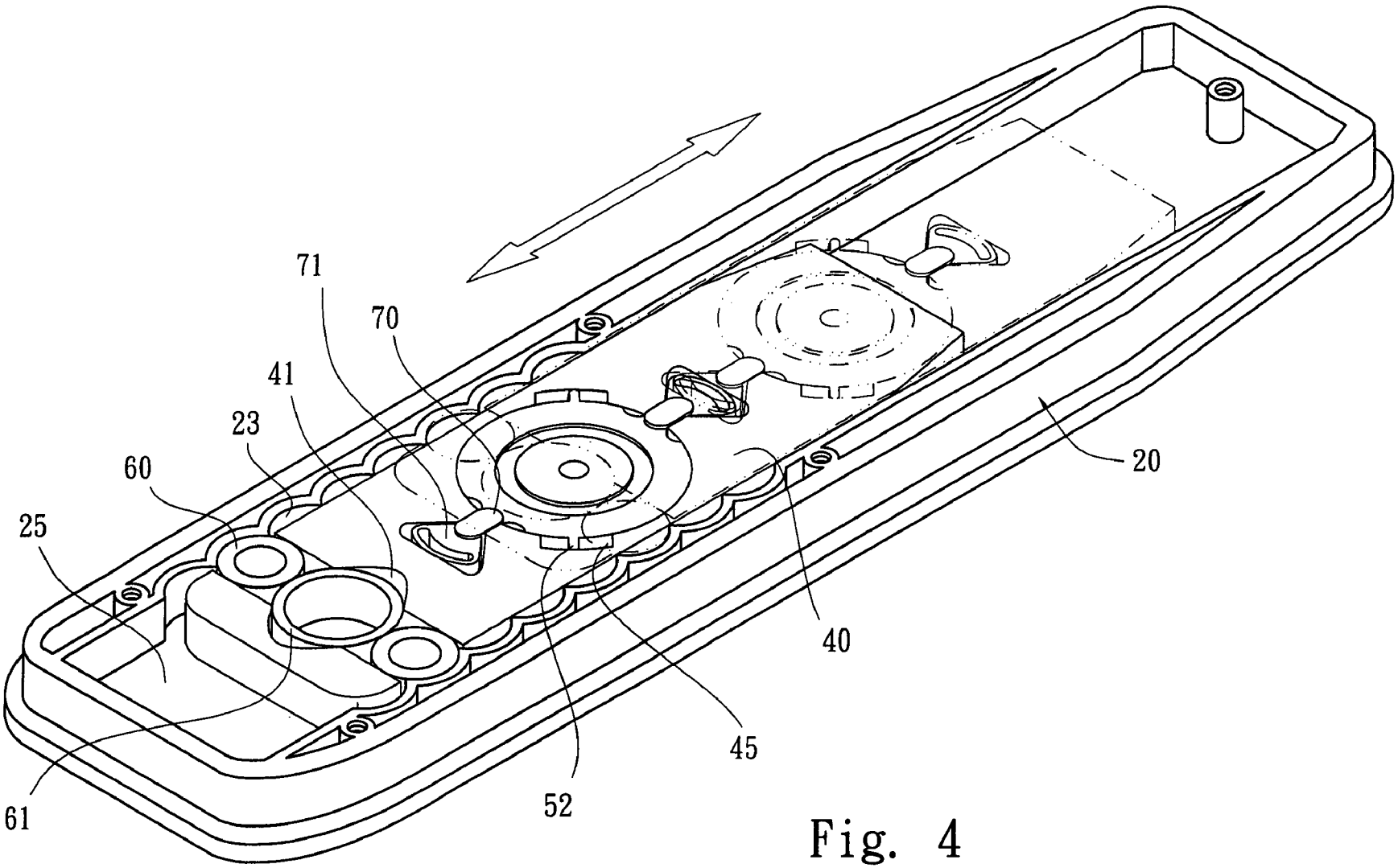
FIG. 4 is a schematic drawing showing longitudinal adjustment of the present invention.
Figure 5:
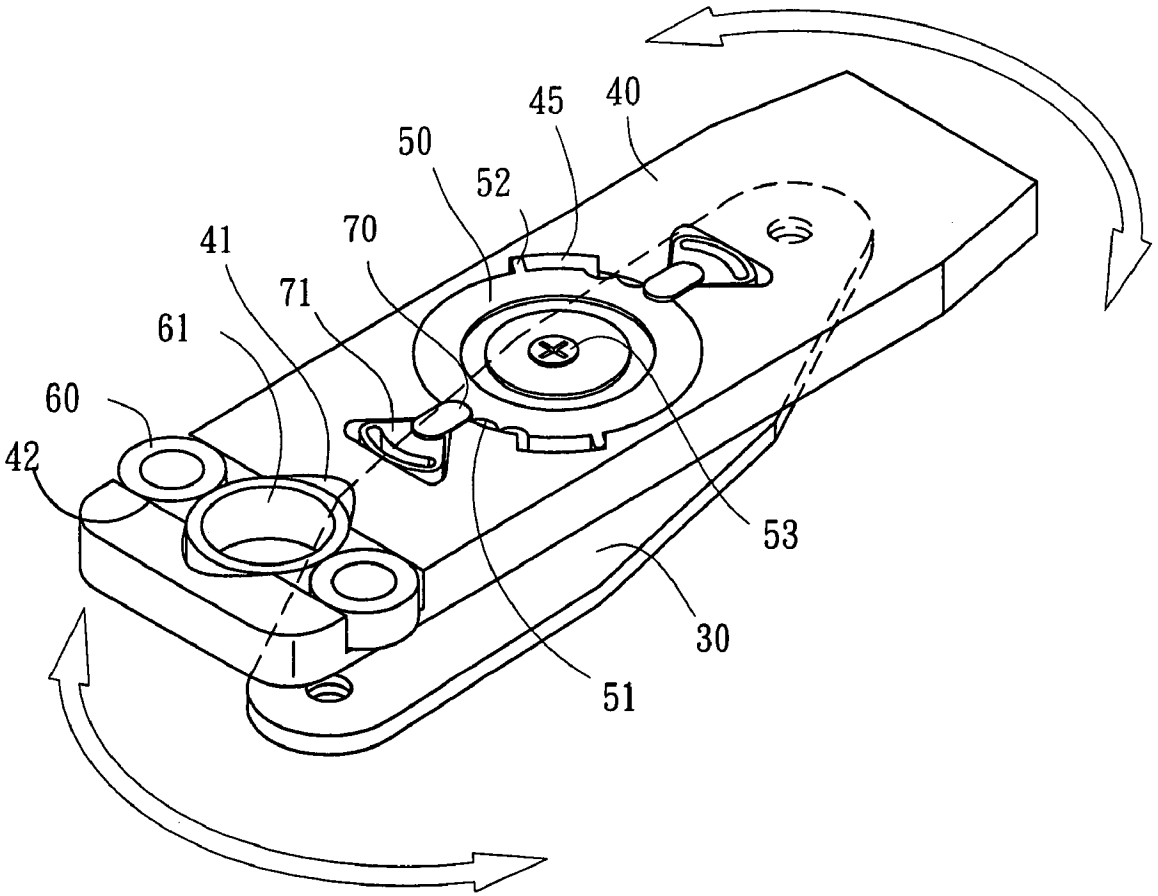
FIG. 5 is a schematic drawing showing adjustment of angles of the present invention.

The disc 50 is secured and integrated with the base 30 and the base is fixed on the handrail support 2. Thus the disc 50 and the base 30 are stationary, relative to the handrail support 2 while the removable block 40 rotates in a certain angle, relative to the disc 50 without longitudinal movement. The handrail body 10 is secured and integrated with the lower plate 20 and then the assembly moves together. Therefore, the assembly of the handrail body 10, the lower plate 20 and the removable block 40 can rotates in a certain angle, relative to the disc 50, as shown in FIG. 5. And the combinations of the handrail body 10 and the lower plate 20 move longitudinally, relative to the removable block 40, as shown in FIG. 4. Thus the assembly of the handrail body 10 and the lower plate 20 can rotate at a certain angle and move forward and backward, relative to the disc 50 (and the base 30) so as to adjust the longitudinal positions and rotation angle. While operating, users only need to apply force to the handrail body 10, then by the locating rings 60 in combinations with the curved slots 23 near the linear locating slots 22, the longitudinal positions of the handrail body 10 is adjusted and located. Moreover, by the locating pin 70 in combination with the the locating slot 51 of the disc 50, users can select the best rotation angle of the handrail body 10 from one of the following directions: leftward, forward, and rightward, as shown in figure, and locate the handrail body 10. Thus the device is easy to operate.

Figure 6:
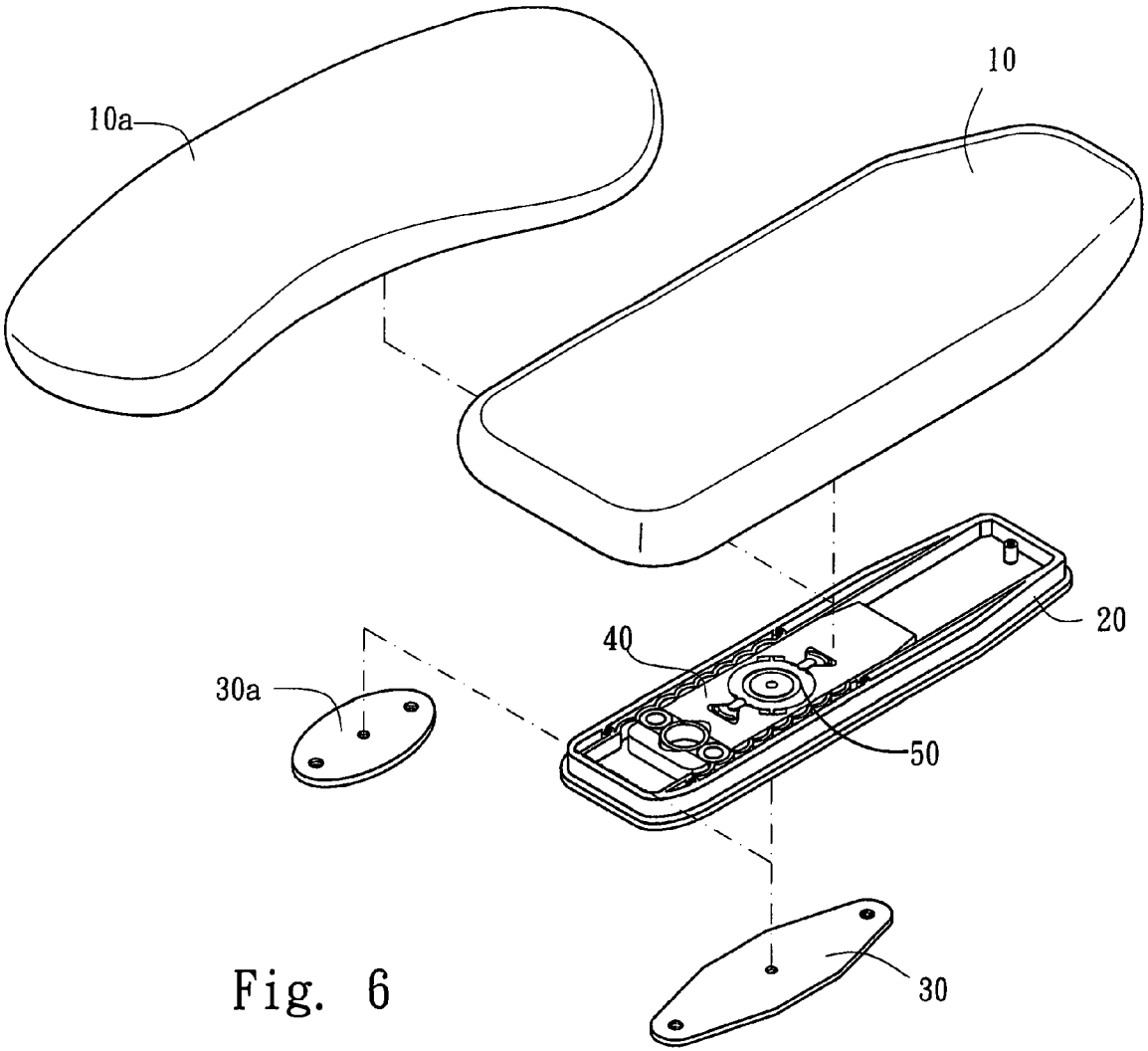
FIG. 6 is an explosive view showing assembling of a support and a handrail in accordance with the present invention.

In addition, conventional handrails with adjustable vertical or longitudinal positions has the handrail body and the lower plate secured with each other by two lock holes on the lower plate while the two lock holes are also used for securing the support with the assembly of the handrail body and the lower plate. When manufacturing, the handrail (the assembly of the handrail body and the lower plate) are integrated with the support by the two lock holes for packaging or transportation. However, the volume of the assembly of the handrail with the support is quite large and inconvenient for packaging or transportation. Moreover, there are various shapes and designs of the handrails or supports so that the distance between the two lock holes varies—at least two types—wide or narrow. As shown in FIG. 6, there are two kinds of base 30 with wide distance and 30*a* with narrow distance between the two lock holes. Thus there are limitations on the support due to the fixed distance between the two lock holes. It's negative for mass-production and customization.

The present invention further includes a base 30/30*a* under the handrail (the assembly of the handrail body and the lower plate). Firstly, the base 30/30*a* is fastened with the disc 50 and the assembly is secured on handrail support 2 by lock holes 32 on two sides of the base 30 or 30*a*. In manufacturing process, the base 30 or 30*a*, the lower plate 20 and inner parts such as removable block 40, the disc 50, the locating ring 60, the elastic member 61, the locating pin 70 and the elastic member 71 can be mass-produced. Then according to users needs, various handrail bodies 10, 10*a* or supports are selected. Then the suitable base 30/30*a* are used depending on distance between the two locks holes of the supports and are assembled with the handrail body 10/10*a*, the lower plate 20 and inner parts to form a handrail that is packaged or transported separately from the support. Then the handrail and the support are assembled in users' end. This is convenient for production and sales.

What is claimed is:

1. An handrail adjustment mechanism comprising a handrail body, a lower plate, a removable block, a disc, a locating ring as well as corresponding elastic member, a locating pin as well as corresponding elastic member, and a base; wherein the handrail body is fastened on top of the lower plate; the lower plate is a plastic concave housing, fastened under the handrail body so as to form a space between the handrail body and the lower plate for accommodation of the removable block, the disc, the locating ring, the elastic member, the locating pin and the elastic member; a linear locating slot having a plurality of identical curved slots is disposed on inner left and right sides of the lower plat;

the removable block with a transverse groove is arranged between the two linear locating slots; two locating rings with an elastic member therebetween are disposed symmetrically on right and left sides of the transverse groove; the elastic member elastically presses the locating rings against the curved slot of the linear locating slot; a round slot is arranged on the removable block for being assembled with the disc while two sets of locating slots are arranged on edge of the circumference of the disc; a race with the locating pin and the elastic member is disposed on front edge and rear edge of the round slot; the elastic member elastically presses the locating pin against the locating slot of the disc; a fastening member inserting through the center of the disc, the removable block and the transverse sliding slot of the lower plate, and a central hole of the base for integrated into a part; and the base having a lock hole on two sides respectively thereof fastened with the disc by the central hole;

thereby the handrail body, the lower plate and the removable block all rotates synchronously with the disc and are located at an angle while the handrail body and the lower plate both moves in longitudinal direction, synchronous and relative to the removable block and are located in a position; thus the assembly of the handrail body and the lower plate rotates at an angle and moves in longitudinal direction, relative to the disc.

2. The handrail adjustment mechanism as claimed in claim 1, wherein the handrail body includes an upper soft pad layer and a lower hard plate layer.

3. The handrail adjustment mechanism as claimed in claim 1, wherein the elastic member is ring made from rubber with elasticity.

4. The handrail adjustment mechanism as claimed in claim 1, wherein each set of locating slots on edge of the circumference of the disc includes three locating slots, located on the central line, center-left and the center-right side of the disc respectively.

5. The handrail adjustment mechanism as claimed in claim 1, wherein a gap is disposed on inner right and left sides of the lower plate and the linear locating slot.

6. The handrail adjustment mechanism as claimed in claim 1, wherein two central-angle slots corresponding to two tenons on the disc respectively are arranged on circumstance of the round slot and the tenon moves inside the central-angle slot so as to restrict the rotation angle of the removable block toward the disc.

* * * * *